US007465210B2

(12) United States Patent
Kim et al.

(10) Patent No.: US 7,465,210 B2
(45) Date of Patent: Dec. 16, 2008

(54) METHOD OF FABRICATING CARBIDE AND NITRIDE NANO ELECTRON EMITTERS

(75) Inventors: Dong-Wook Kim, San Diego, CA (US); Sungho Jin, San Diego, CA (US); In-Kyung Yoo, Yongin-shi (KR); Li-Han Chen, San Diego, CA (US)

(73) Assignees: The Regents of the University of California, Oakland, CA (US); Samsung Electronics Co., Ltd., Gyeonggi-do (KR)

( * ) Notice: Subject to any disclaimer, the term of this patent is extended or adjusted under 35 U.S.C. 154(b) by 578 days.

(21) Appl. No.: 11/060,153

(22) Filed: Feb. 17, 2005

(65) Prior Publication Data

US 2008/0287030 A1 Nov. 20, 2008

Related U.S. Application Data

(60) Provisional application No. 60/547,459, filed on Feb. 25, 2004, provisional application No. 60/568,643, filed on May 6, 2004.

(51) Int. Cl.
*H01J 9/00* (2006.01)
*H01J 9/39* (2006.01)
*H01J 9/04* (2006.01)

(52) U.S. Cl. ..... 445/46; 445/51; 445/57
(58) Field of Classification Search ..... 445/46, 445/51, 57
See application file for complete search history.

(56) References Cited

U.S. PATENT DOCUMENTS

| | | | | |
|---|---|---|---|---|
| 4,749,587 | A * | 6/1988 | Bergmann et al. | 427/570 |
| 5,075,591 | A * | 12/1991 | Holmberg | 313/495 |
| 5,079,112 | A | 1/1992 | Berger et al. | 430/4 |
| 5,532,496 | A | 7/1996 | Gaston | 250/492.22 |
| 5,654,497 | A | 8/1997 | Hoffheins et al. | 73/23.2 |
| 5,982,095 | A | 11/1999 | Jin et al. | 313/582 |
| 6,036,774 | A | 3/2000 | Lieber et al. | 117/105 |
| 6,091,190 | A | 7/2000 | Chalamala et al. | 313/346 |
| 6,283,812 | B1 | 9/2001 | Jin et al. | 445/24 |
| 6,297,592 | B1 | 10/2001 | Goren et al. | 315/3.5 |
| 6,340,822 | B1 * | 1/2002 | Brown et al. | 257/25 |

(Continued)

FOREIGN PATENT DOCUMENTS

KR 10-2002-0049630 6/2002

(Continued)

OTHER PUBLICATIONS

Office Action for corresponding Korean Application No. 10-2005-0015376 dated May 26, 2006 and English Translation thereof.

(Continued)

*Primary Examiner*—Sikha Roy
*Assistant Examiner*—Anne M Hines
(74) *Attorney, Agent, or Firm*—Harness, Dickey & Pierce, P.L.C.

(57) ABSTRACT

This invention discloses novel field emitters which exhibit improved emission characteristics combined with improved emitter stability, in particular, new types of carbide or nitride based electron field emitters with desirable nanoscale, aligned and sharped-tip emitter structures.

20 Claims, 16 Drawing Sheets

U.S. PATENT DOCUMENTS

| | | | | |
|---|---|---|---|---|
| 6,504,292 | B1 * | 1/2003 | Choi et al. | 313/310 |
| 6,649,403 | B1 | 11/2003 | McDevitt et al. | 435/288.5 |
| 6,649,431 | B2 * | 11/2003 | Merkulov et al. | 438/20 |
| 2004/0067602 | A1 * | 4/2004 | Jin | 438/22 |

FOREIGN PATENT DOCUMENTS

KR 10-2003-0060611 7/2003

OTHER PUBLICATIONS

Liu, J. et al., "Fullerene Pipes," Science, vol. 280 pp. 1253-1256 (May 22, 1998).
Ren, Z.F. et al., "Synthesis of Large Arrays of Well-Aligned Carbon Nanotubes on Glass," Science, vol. 282, pp. 1105-1107 (Nov. 6, 1998).
Li, W.Z. et al., "Large-Scale Synthesis of Aligned Carbon Nanotubes," Science, vol. 274, pp. 1701-1703 (Dec. 6, 1996).
Tans, Sander J. et al., "Individual single-wall carbon nanotubes as quantum wires," Nature, vol. 386, pp. 474-477 (Apr. 3, 1997).
Fan, S., et al., "Self-Oriented Regular Arrays of Carbon Nanotubes and Their Field Emission Properties," Science, vol. 283, pp. 512-514 (Jan. 22, 1999).
Bower, C. et al., "Plasma-induced alignment of carbon nanotubes," Applied Physics Letters, vol. 77, No. 6, pp. 830-832 (Aug. 7, 2000).
Bower, C. et al., "Nucleation and growth of carbon nanotubes by microwave plasma chemical vapor deposition," Applied Physics Letters, vol. 77, No. 17, pp. 2767-2769 (Oct. 23, 2000).
Merkulov, Vladimir I. et al., "Shaping carbon nanostructures by controlling the synthesis process", Applied Physics Letters, vol. 79, No. 8, pp. 1178-1180 (2001).
Teo, KBK et al., "Plasma enhanced chemical vapour deposition carbon nanotubes/nanofibres—how uniform do they grow?", Institute of Physics Publishing, Nanotechnology 14, pp. 204-211 (2003).
Tsai, C.L. et al., "Bias effect on the growth of carbon nanotips using microwave plasma chemical vapor deposition", Applied Physics Letters, vol. 81, No. 4, pp. 721-723 (2002).
Dean, Kenneth A., et al., "The environmental stability of field emission from single-walled carbon nanotubes", Applied Physics Letters, vol. 75, No. 19, pp. 3017-3019 (1999).
Mackie, W.A. et al., "Emission and Processing Requirements for Carbide Films on MO Field Emitters", Mat. Res. Soc Symp. Proc. vol. 509, pp. 173-178 (1998).
Rouse, Ambrosio A. et al., "Field emission from molybdenum carbide", Applied Physics Letters, vol. 76, No. 18, pp. 2583-2585 (2000).
Adachi, Hiroshi et al., "Stable carbide field emitter", Appl. Phys. Lett. 43 (7), pp. 702-703 (1983).
Gilmour, Jr., A.S., Microwave Tubes, Chapter 8, "Gridded Tubes", Artech House, pp. 191-313 (1986).
Huang, Michael H. et al., "Room-Temperature Ultraviolet Nanowire Nanolasers", Science, vol. 292, pp. 1897-1899 (2001).
Aggarwal, S. et al., "Spontaneous Ordering of Oxide Nanostructures", Science, vol. 287, pp. 2235-2237 (2000).
Luo, Yun et al., "Nanoshell tubes of ferroelectric lead zirconate titanate and barium titanate", Applied Physics Letters, vol. 83, No. 3, pp. 440-442 (2003).
Li, Chao et al., "$In_2O_3$ nanowires as chemical sensors", Applied Physics Letters, vol. 82, No. 10, pp. 1613-1615 (2003).
Kong, Y.C. et al., "Ultraviolet-emitting ZnO nanowires synthesized by a physical vapor deposition approach", Applied Physics Letters, vol. 78, No. 4, pp. 407-409 (2001).

* cited by examiner (a) Carbon nanotube array template, (b) aligned nanoscale field emitter array of refractory carbide or nitride prepared by coating of nanotube template.

(a) Carbon nanotube array template, (b) refractory metal deposition, (c) conversion to carbide coating by heat treatment.

Control of Emitter Tip Geometry

Comparative Emitter Tip Geometry

(a) Aligned Nanotubes (b) Aligned NanoCones

Effect of Applied Electric field on NanoCone formation

Patterned Carbon Nanocones (7 nm thick, 200nm dia. Ni islands)

TaCO emitter surface prepared by diffusional reaction of (Ta+C)

Carbide or nitride emitter in combination with a semiconductor intermediary layer which serves as a series resistor.

Improved NanoCone Field Emitters (a) Top View (b) Front View

Masks for E-beam Projection Lithography

METHOD OF FABRICATING CARBIDE AND NITRIDE NANO ELECTRON EMITTERS

CROSS REFERENCE TO RELATED APPLICATIONS

This application claims the benefit of two United States Provisional applications: 1) Ser. No. 60/547,459 filed by Dong-Wook Kim, et al. on Feb. 25, 2004 ("Article Comprising Carbide and Nitride Nano Electron Emitters and Fabrication Method Thereof") and 2) Ser. No. 60/568,643 filed by Dong-Wook Kim, et al. on May 6, 2004 and bearing the same title. Both said provisional applications are incorporated herein by reference.

FIELD OF THE INVENTION

This invention relates to carbide and nitride electron field emitter structures, and in particular, to such structures using carbon nanostructures as templates.

BACKGROUND OF THE INVENTION

Field emitting devices are useful in a wide variety of applications, such as field emission flat panel displays, microwave power amplifiers, and nano-fabrication tools. See U.S. Pat. No. 6,283,812 by Jin, et al "Process for fabricating article comprising aligned truncated carbon nanotubes" issued on Sep. 4, 2001, and U.S. Pat. No. 6,297,592 by Goren, et al., "Microwave vacuum tube device employing grid-modulated cold cathode source having nanotube emitters" issued on Oct. 2, 2001. A typical field emitting device comprises a field emitting assembly composed of a cathode and one or more field emitter tips. The device also typically includes a grid closely spaced to the emitter tips and an anode spaced further from the cathode. Voltage induces emission of electrons from the tips, through the grid, toward the anode.

Small diameter nanowires, such as carbon nanotubes with a diameter on the order of 1-100 nanometers, have received considerable attention in recent years. See Liu et al., Science, Vol. 280, p. 1253 (1998); Ren et al., Science, Vol. 282, p. 1105 (1998); Li et al., Science, Vol. 274, p. 1701 (1996); J. Tans et al., Nature, Vol. 36, p. 474 (1997); Fan et al., Science, Vol. 283, p. 512 (1999); Bower et als., Applied Physics Letters, Vol. 77, p. 830 (2000), and Applied Physics Letters, Vol. 77, p. 2767 (2000), Merkulov et al., Applied Physics Letters, Vol. 79, p. 1178 (2001); and Tsai et al., Applied Physics Letters, Vol. 81, p. 721 (2002); Teo et al., Nanotechnology, Vol. 14, p. 204 (2003). Such a structure with a nanoscale, high aspect ratio configuration is important for field emission applications because of the significant advantage of field concentration in such structures as the emitter operation can be conducted at a low applied voltage with much higher emission currents.

Long term reliability and stability of field emission emitter tips is of paramount importance. High-current, high-field operating conditions can subject emitter tips to Joule heating, oxidation, electromigration, and diffusion driven by the electrostatic stress near the sharp tip, all of which can lead to deterioration and even destruction of the emitters.

Instability of the emission current under certain emitter and vacuum conditions in carbon nanotubes is well known. It can, for example, be caused by the presence of oxygen impurity or other adsorbed gas species. See an article by K. Dean and B. R. Chalamala, *J. Appl. Phy.* 85, 3832 (1999). The oxidation rate will be generally proportional to the oxygen partial pressure. However, such undesirable oxidation is possible even in the ultra high vacuum conditions used for field emission devices. The variation of emission characteristics among different nanotubes (e.g. variation in nanotube height, tip sharpness, or size and shape of catalyst particles) can also cause significant instability problems as the strongly emitting nanotubes tend to deteriorate first. Some of the strongly emitting nanotubes can get very hot even in a display-type low current operations (e.g., >1600° C.). Continuous degradation of carbon nanotube tips can occur in the presence of cold cathode electric field and some unavoidable residual oxygen in field emission vacuum. The damage to nanotubes occurs through either a tip burning into $CO_2$ or field evaporation of the tip under high current (and hence high temperature) operation.

Metallic Spindt tip emitters such as Mo or Ir tips also have emitter instability problems. For example, oxygen impurity in non-UHV vacuum conditions and ion bombardment and the occurrence of undesirable nanoprotrusions on metal emitter tips can result in a time-dependent increase in emission current and eventual catastrophic emitter failure.

Carbon nanotubes (CNT) are generally considered one of the best electron field emitters. Their high aspect-ratio geometry and resultant electric field concentration allows significant electron emission at relatively low applied fields. However, field emission is both a function of the field concentration factor and the work function of the emitter. Carbon nanotubes are not exceptionally good in the latter, having a relatively large work function ($\phi$~5.0 eV). There are many other materials which have lower work functions than CNTs, for example, ~3.8 eV for TaC, ~3.3 eV for TiN, ~4.2 eV for Ta, and ~4.5 eV for W. Some of these materials also are more stable (having strong atomic bonding and high melting temperatures).

One reason why these better materials have not been fully utilized for field emitters is the difficulty of fabricating them into an array of field-concentrating, sharp-tipped emitters. While a complicated lithography process enables fabrication of sharp Mo tips in Spindt emitters, they are complex and costly to fabricate and suffer reliability problems. The well known nanoprotrusion phenomenon and runaway emission, and sensitivity to oxygen have added to some serious barriers to successful, large-scale applications of such field emission cold cathodes. The carbides and nitrides have proven to be much more robust field emitters. See articles published by W. A. Mackie, T. Xie, M. R. Matthews, and P. R. Davis, *in Materials Issues in Vacuum Microelectronics*, Materials Research Society Symposium Proceedings Volume 509, p. 173 (1998), by A. A. Rouse, J. B. Bernhard, E. D. Sosa, D. E. Golden, *Applied Physics Letters* 76, 2583 (2000), and by H. Adachi, K. Fujii, S. Zaima, y. Shibata, *Applied Physics Letters* 43, 702 (1983). However, the construction of desirable field emitter configuration such as an array of spaced-apart nanotips, which is crucial for obtaining high emission current at low electric fields, has not been demonstrated for such carbide or nitride materials. Therefore, there is a need for nano array electron field emitters with improved field emission stability, at the same time with high current capability at low applied field.

SUMMARY OF THE INVENTION

This invention discloses novel field emitters which exhibit improved emission characteristics combined with improved emitter stability, in particular, new types of carbide or nitride based electron field emitters with desirable nanoscale, aligned and sharped-tip emitter structures.

BRIEF DESCRIPTION OF THE DRAWINGS

For a better understanding of the invention, exemplary embodiments are described below in connection with the accompanying drawings. In the drawings.

It is to be understood that these drawings are for the purposes of illustrating the concepts of the invention and are not to scale.

DETAILED DESCRIPTION OF THE INVENTION

For efficient field emission of electrons, a high concentration of electric field is desired so as to allow operation of field emitter at relatively low and practical applied electric fields. Carbon nanotubes (CNT) are generally considered as one of the best electron field emitters is because of their high aspect-ratio geometry and resultant electric field concentration which allows significant electron emission at relatively low applied fields. However, field emission is both a function of the field concentration factor and the work function of the emitter. Carbon nanotubes are not exceptionally good in this respect, with a relatively large work function ($\phi$~5.0 eV). Carbides and nitrides, especially refractory carbides and nitrides provide even lower work functions than that for CNTs, for example, ~3.8 eV for TaC and ~3.3 eV for TiN. Having strong atomic bonding and high melting temperatures, these refractory metal carbides and nitrides are mechanically and thermally very stable (some with an even higher melting temperature than tungsten (m.p.=3400° C.). Some examples are—TaC ($\phi$~3.8 eV, m.p.=3880° C.), HfC ($\phi$~4.1 eV, m.p.=3890° C.), ZrC ($\phi$~3.6 eV, m.p.=3540° C.), HfN ($\phi$~4.3 eV, m.p.=3300° C.) and TiN ($\phi$~3.3 eV, m.p.=2930° C.). One of the reasons why these better materials have not been fully utilized for field emitters is the difficulty of fabricating them into an array of field-concentrating, sharp-tipped emitters.

While the carbides and nitrides have proven to be much more robust field emitters, the construction of desirable field emitter configuration such as an array of nanoscale, spaced-apart nanotips, which is crucial for obtaining high emission current at low electric fields, has not been demonstrated for such carbide or nitride materials. In this application we disclose desirable carbide or nitride emitters and describe methods for making them.

Figure 1:
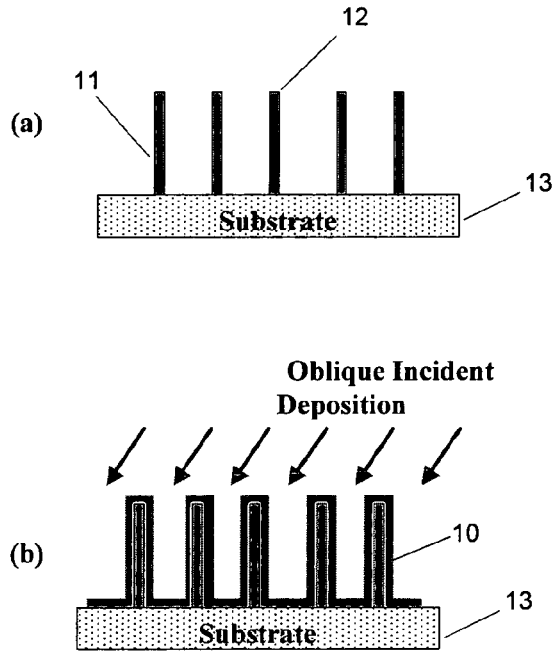
FIGS. 1(*a*) and 1(*b*) schematically illustrate an exemplary process of creating an aligned, nanoscale field emitter array of carbide or nitride field emitters by deposition of carbide or nitride material on a carbon nanotube array template.

Referring to the drawing, FIG. 1 schematically illustrates an exemplary process of creating an aligned, nanoscale field emitter array of carbide or nitride field emitters by deposition of carbide or nitride material 10 on a template 11 of carbon nanostructures 12 supported on a substrate 13 (FIG. 1(*a*)). The preferred carbon nanostructures are those such as nanotubes, nanocones or nanowires that project outwardly from the substrate surface. Such a deposition of a carbide or nitride surface layer onto the carbon nanotube template conveniently utilizes the well defined nanoscale nanotube dimension and the ease of fabricating aligned and patterned nanotube arrays. The preferred carbide or nitride materials are refractory or refractory-like carbides or nitrides. These materials have high melting points and strong bonding, thus providing stability of the materials. The desired carbide or nitride emitter materials include HfC, TaC, WC, ZrC, NbC, MoC, TiC, VC, $Cr_3C_2$ and their variations in stoichiometry, and HfN, TaN, WN, ZrN, NbN, MoN, TiN, VN, CrN and their variations in stoichiometry. The desired thickness of the carbide or nitride emitter material on the surface of the high-aspect-ratio inventive emitters should be sufficient to cover at least to continuously cover the emitter surface, for example, covering at least 20% of the surface in the upper ⅓ of the high-aspect-ratio nanostructure emitter height, where the field emission predominantly takes place because of stronger field concentration. The thickness should not be so thick as to blunt the nanotip configuration. The range of desired coating thickness is in the range of 0.5-100 nm, and preferably 2-20 nm.

The deposition of the carbide or nitride emitter materials on carbon nanotube template can be carried out by DC or RF sputtering from a target with the desired final carbide or nitride composition, co-sputtering from two or more sputtering targets, reactive sputtering using a carbon- or nitrogen-containing gas as a source of carbon or nitrogen during sputtering, thermal evaporation, electron-beam evaporation, laser ablation, chemical vapor deposition, and variations of these techniques. After deposition of the carbide or nitride emitter layer, an optional annealing heat treatment is given. Such a heat treatment provides an improved adhesion by allowing some diffusion at the interface between the carbide or nitride coating material and the carbon template base, and also relieves local stresses associated with the thin film deposition process as well as with the contact of dissimilar materials with different lattice parameters and thermal expansion coefficients.

Because of the shadow effect by neighboring nanotubes, it is sometimes difficult to uniformly coat the nanotubes/nanofibers especially if the length-to-diameter aspect ratio is high, as is sometimes the case for the aligned carbon nanotube array. In this case, the coating source beam is desirably directed obliquely incident on the substrate and the substrate is rotated. When the mean free path of molecules is much smaller than the distance between the source and the substrate (like a typical sputtering environment), such a shadowing effect is much smaller than in the case of evaporation process. The resultant structure, FIG. 1(*b*), has a desirable nanostructure dimension with a high aspect ratio and a small diameter (equivalent to a sharp tip) suitable for field emission at a practical low electric fields. The desired diameter of the inventive, carbide or nitride coated emitter structure of FIG. 1(*b*) is less than 200 nm, preferably less than 50 nm. Alternatively, a somewhat larger diameter nanostructure can be used, provided that the tip region is tapered to a sharp geometry with the radius of curvature less than 200 nm, and preferably less than 50 nm.

Figure 2:
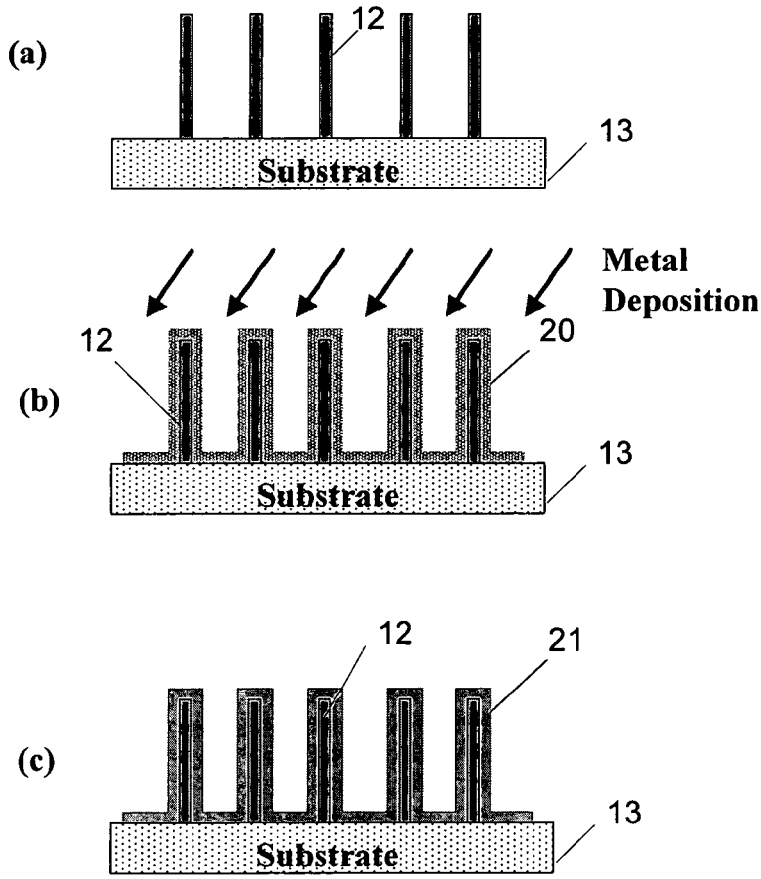
FIGS. 2(*a*), 2(*b*) and 2(*c*) schematically show an exemplary inventive process of creating an aligned, nanoscale field emitter array of carbide or nitride field emitters by deposition of a component metal followed by conversion of the surface material to carbide or nitride by heat treatment.

FIG. 2 shows an alternative technique of fabricating the carbide or nitride coated emitter structure. In this approach, an aligned, nanoscale field emitter array of carbide or nitride field emitters is created by first depositing a component metal 20 (FIG. 2(*b*)) as by sputtering, evaporation or chemical vapor deposition (CVD). The surface material is then converted to carbide or nitride 21 by heat treatment (FIG. 2(*c*)). In the case of carbide emitter surface, the process can utilize the existing carbon nanotube template material as a conveniently located, intimately contacting source of carbon. For example, if a metallic tantalum (Ta) is deposited on carbon nanotube surface and then the structure subjected to a sufficiently high heat treatment temperature, a diffusional reaction takes place for the Ta and C to combine and form a TaC compound. The heat treatment is carried out in an inert gas or carbon-containing gas, as the inadvertent presence of oxygen can cause undesirable burning away of carbon nanotube material as CO or $CO_2$ gas. The desired heat treatment temperature and time for such diffusional formation of carbide emitter layer is in the range of 500-2500° C., preferably 800-1600° C., for a period in the range of 1 minutes to 1000 hrs, preferably 5 minutes to 100 hrs. In the case of nitride based emitters, the heat treatment is preferentially carried out in a nitrogen-containing atmosphere such as nitrogen gas or ammonia gas optionally together with an inert gas or hydrogen gas.

Figure 3:
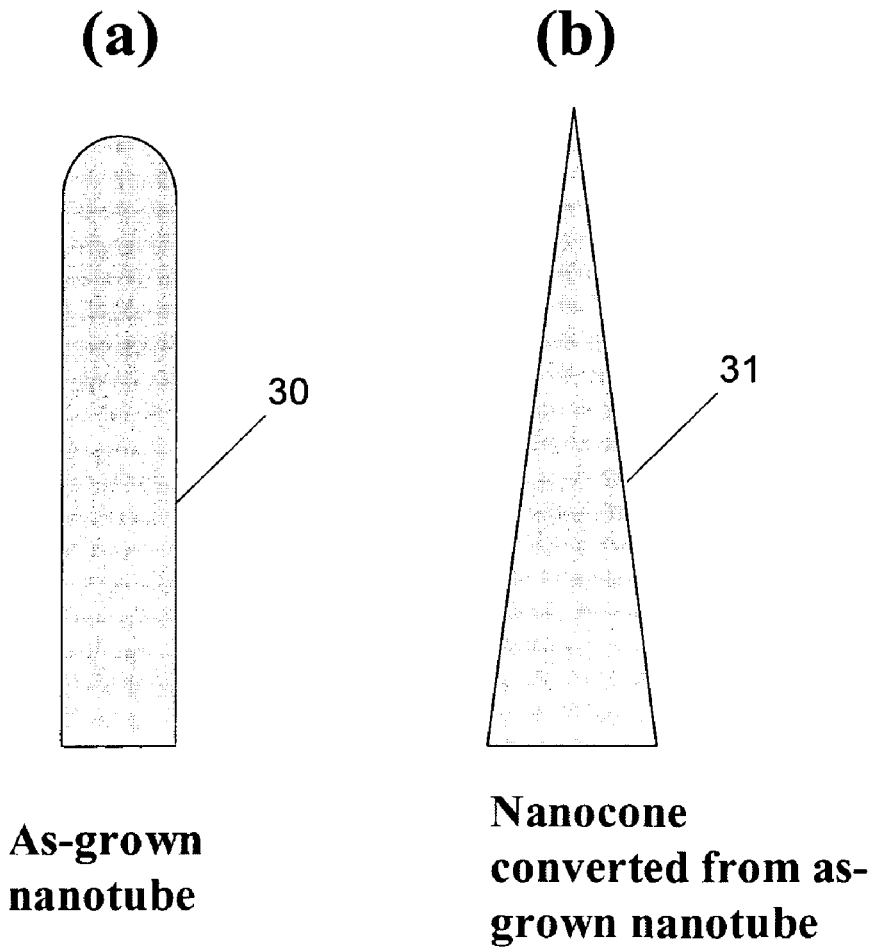
FIGS. 3(*a*) and 3(*b*) schematically illustrate a comparative morphology of a nanoscale tube or rod shape field emitter vs a nanocone-shaped field emitter which is produced by conversion of the nanotube through electric field CVD treatment.

As the emitter tip geometry is one of the most important parameters in field emission, advantageously the carbide or nitride nano emitter tip sharpness is controlled as illustrated schematically in FIG. 3. The nanotube structure 30 of FIG. 3(*a*) is preferably converted to a sharp-tipped nanocone structure 31 of FIG. 3(*b*) by appropriate electric field CVD processing. For example, such a nanotube 30 base structure (FIG. 4(*a*)) can be prepared, for example, by CVD processing using a mixed feedstock gas of 20% acetylene and 80% ammonia gas at an overall flow rate of ~180 cubic centimeter per minute, at the CVD temperature of ~700° C. for 20 minutes. The DC plasma can be operated at ~450 volts, starting with the ammonia plasma for 1 minute before switching over to the combined acetylene and ammonia plasma for aligned nanotube growth of FIG. 4(*a*). The nanotube-nucleating catalyst (Ni) can be deposited on a Si substrate as a very thin film of ~5 nm thickness, which then breaks up into islands on heating to the CVD temperature of ~700° C., which then serve as nuclei for CNT formation. The structure of FIG. 3(*a*) or FIG. 4(*a*) is then subjected to a separate CVD processing so as to convert the nanotube (30) into nanocone structure 31 of FIG. 3(*b*) or FIG. 4(*b*). The processing calls for the use of electric field within a specific regime of ~550±50 Volts (~700±70V/cm overall applied field) for such a conversion to take place. While such an aligned nanocone structure can be formed by a direct CVD deposition at a certain applied field during CVD processing, the control is very difficult as can be seen in FIG. 5. A slight variation in applied field results in a rather drastic, uncontrollable changes in the nanotube/nanocone morphology. Resulting structures are shown for fields of 450, 500, 550 and 600 volts. However, having grown the nanotubes first, and then converting to nanocones provides an improved reproducibility and control for growth of sharp and high-aspect-ratio nanocones, and thus is a preferred processing route as compared to a direct, single-step nanocone fabrication.

Figure 6:
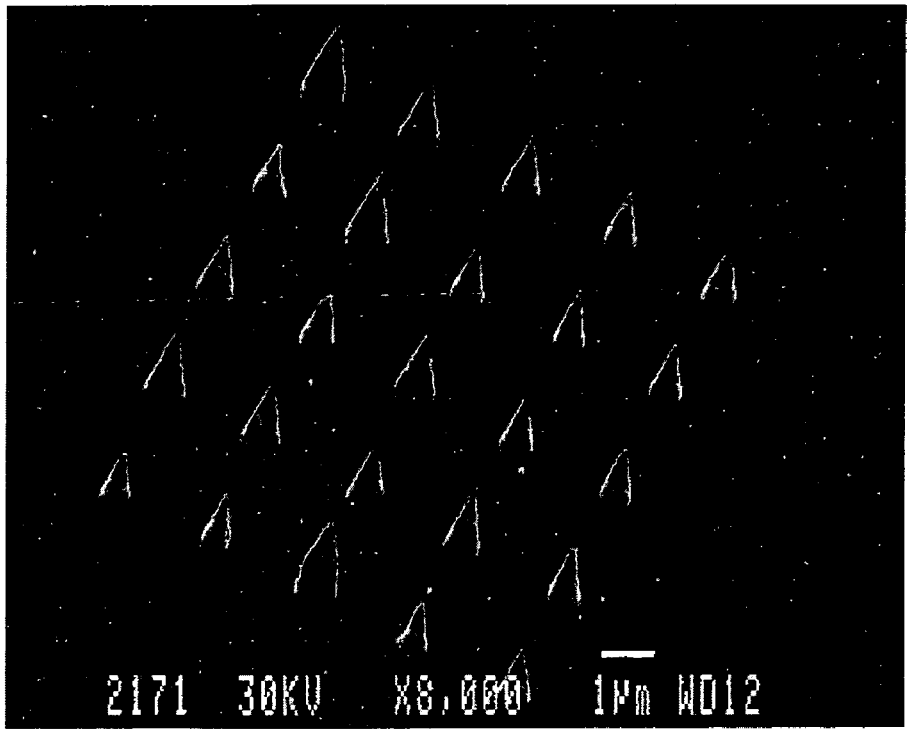
FIG. 6 illustrates an exemplary periodic array of carbon nanocone structure utilized as a template for creation of inventive carbide or nitride nano field emitters.

The desired nanocone configurations in the preferred field emitters include a base diameter (at the bottom of the nanocone) in the range of 20-2000 nm, preferably in the range of 50-500 nm, and the aspect ratio (height to base diameter ratio) in the range of 1-50, preferably 2-10. Shown in FIG. 6 is an exemplary periodic array of carbon nanocone structures utilized as a template for creation of carbide or nitride nano field emitters. Such a periodic array of carbon nanocones was obtained by e-beam lithographic patterning of the metal catalyst layer on Si substrate, followed by nanotube growth process for FIG. 3(*a*) or FIG. 4(*a*) structure, followed by the electric field CVD process of converting them to nanocones.

Figure 4:
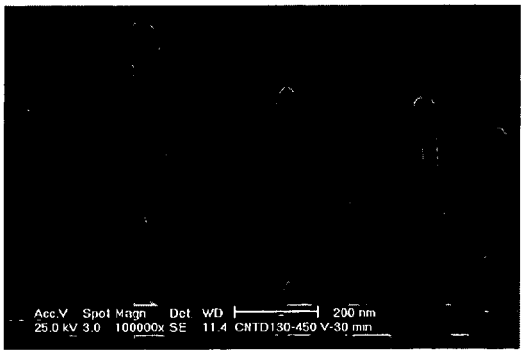
FIGS. 4(*a*) and 4(*b*) show SEM micrographs depicting the prior art nanotube field emitters and inventive nanocone-shaped field emitters converted from the nanotube by applied electric field during CVD processing.
Figure 4:
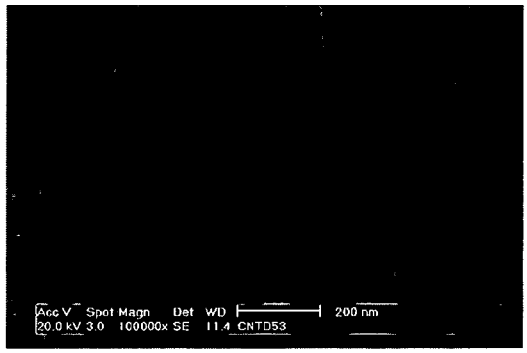
Figure 5:
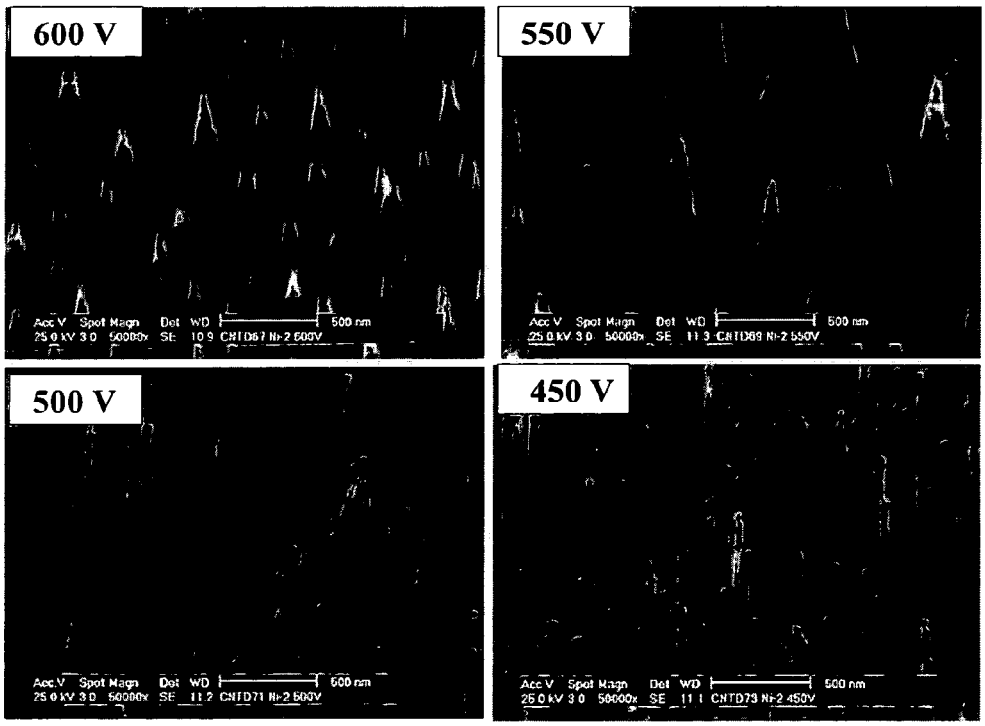
FIG. 5 is a set of SEM micrographs showing the sensitivity of the morphology of nanotubes on the magnitude of nanotube-aligning applied electric field.

The nanocone tip in FIG. 4(*b*) is very sharp, with a radius of curvature estimated to be only ~5 nm, much sharper than that for the nanotubes, and indeed sharper than Spindt tips. The high aspect ratio and the sharp tip geometry, in combination with the larger and sturdier base diameter in the nanocone make it ideal as a mechanically more stable field emitter base. Another significant advantage of nanocone structure of FIG. 3(*b*) as compared to the nanotube structure of FIG. 3(*a*) is the slanted side wall configuration in the nanocones, and associated ease of depositing the carbide or nitride coating directly from above without needing oblique incident deposition and substrate rotation. The fabrication of the carbide or nitride nano field emitter array thus becomes much easier.

As the nanocone fabrication steps often involve high temperature CVD processing at several hundred degrees centigrade, it is noted that depending on the specifics of nanotube fabrication, the carbon nanocones sometimes contain a varying amount of other elements such as silicon or oxygen diffused from the silicon or silicon oxide substrate into the nanocone structure during the high temperature fabrication. Allowable types of other elements in the nanocones (and in nanotubes but with a much less extent) include Si, Ga, As, Al, Ti, La, O, C, B, N, and other substrate-related elements. The amount of such elements can be very small or substantial depending on the temperature, time, and electric field applied during the CVD processing, for example in the range of 0.5 to 70 atomic percent.

Figure 7:
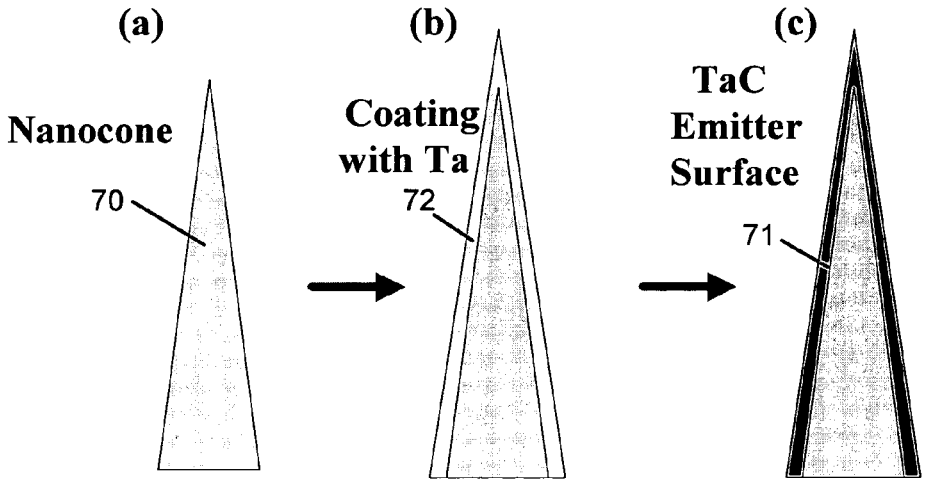
FIGS. 7(*a*), 7(*b*) and 7(*c*) illustrate an exemplary inventive process of converting a carbon nanocone structure into a carbide type nanocone emitter by depositing a precursor metal and inducing diffusional carbide formation by high temperature heat treatment.

FIG. 7 illustrates an exemplary inventive process of converting a carbon nanocone structure 70 into a carbide type nanocone emitter 71 by depositing a precursor metal 72, for example, Hf, Ta, W, Zr, Nb, Mo, Ti, V, Cr, and then inducing diffusional carbide formation by high temperature heat treatment.

Figure 8:
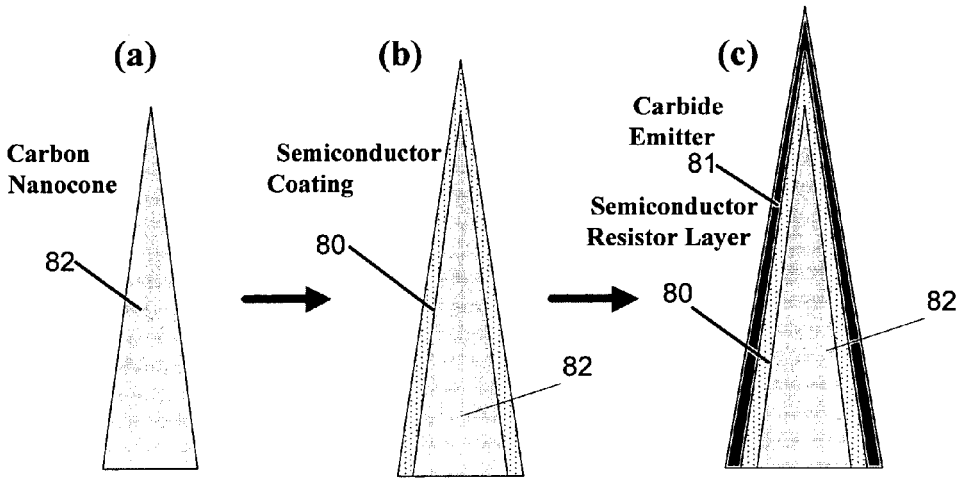
FIGS. 8(*a*), 8(*b*) and 8(*c*) show an alternative embodiment of the inventive carbide or nitride nanocone field emitters incorporating a high electrical resistivity semiconductor intermediary layer between the carbide or nitride emitter surface material and the base carbon template material.

FIG. 8 shows an alternative embodiment of the inventive carbide or nitride nanocone field emitters structure. Here a series resistor is incorporated into the field emitter circuit to improve the emission uniformity. A high-electrical-resistivity material 80 such as a semiconductor intermediary layer is disposed between the carbide or nitride emitter surface material 81 and the base carbon template material 82 as the nanoscale resistor. On a carbon nanocone array base structure (FIG. 8(*a*)), a layer of semiconductor such as doped Si, or amorphous Si or ZnO is deposited as by sputtering, evaporation or CVD (FIG. 8(*b*)). Then the carbide or nitride field emitter layer is deposited (FIG. 8(*c*)), again by sputtering, evaporation or CVD. If the resistivity of the is properly chosen, the voltage drop on passing through the resistor layer will of the semiconductor reduce the variance of emission currents between various nanocone emitters. A nanocone which happens to be a better emitter will have a higher emission current as compared to adjacent emitters. The higher current will result in a larger voltage drop through the resistor, which will reduce the electric field near the tip of the best emitters. Such a resistive current limitation on stronger emitters spreads the emission current over more emitters with a less strong emission, thus improving the overall emission uniformity, device reliability and operating lifetime.

Figure 9:
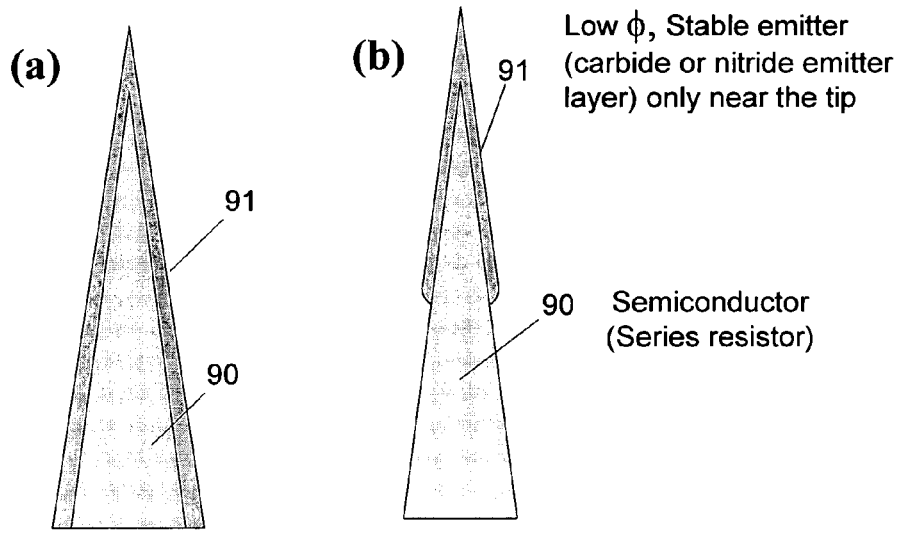
FIGS. 9(*a*) and 9(*b*) represent another alternative embodiment of the invention with the carbide or nitride nanocone field emitters incorporating the intermediary semiconductor resistor layer only near the tip of the carbon nanocone templates.
Figure 10:
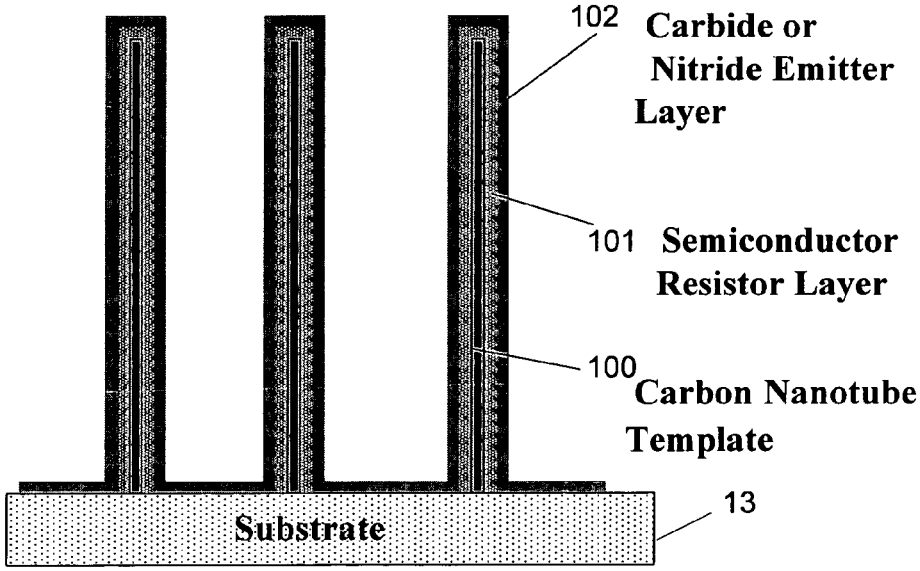
FIG. 10 illustrates yet another alternative embodiment of the inventive carbide or nitride nanocone field emitters incorporating the intermediary semiconductor resistor layer onto the carbon nanotube type template material.

In another alternative embodiment of the invention illustrated in FIG. 9, any sharp-tipped semiconductor nanowires 90 such as Si, ZnO, GaN, Ga—As nanowires can be used as the nanoscale series resistor onto which the carbide or nitride field emitter layer 91 is coated. The carbide or nitride layer can be coated to completely cover the template nanowire (FIG. 9(*a*)), or just the region near the field emitting tip (FIG. 9(*b*)). In FIG. 10, yet another alternative embodiment of the inventive carbide or nitride field emitter nanoarray is illustrated. Here, instead of the nanocone array, regular array of nanotubes 100 is utilized as the template onto which the resistor layer 101 and then the carbide or nitride emitting layer 102 are deposited, preferably using oblique incident deposition and substrate rotation.

The inventive array of periodic and spaced-apart aligned nanowires and nanocones with desirably stable carbide or nitride emitting surfaces can advantageously be utilized for various device or processing tool applications involving electron source. The sharp tip configuration with high aspect ratio in combination with a vertically aligned and laterally spaced field emitter structure is especially advantageous. For example, such desirably configured nanowires with enhanced stability and significantly enhanced field concentrating capability can be utilized as an improved field emission cathode for a microwave amplifier device or for field emission based, flat-panel displays. Such a stable and robust nanowire array can also be useful as powerful electron sources for nano fabrication, such as electron beam lithography or electron projection lithography. These devices and applications involving the inventive structures are described in greater details as follows.

Microwave Amplifiers

Carbon nanotubes are attractive as field emitters because their unique high aspect ratio (>1,000), one-dimensional structure and their small tip radii of curvature (~10 nm) tend to effectively concentrate the electric field. In addition, the perfect atomic arrangement in a nanotube structure imparts superior mechanical strength and chemical stability, both of which make nanotube field emitters robust especially for high current applications such as microwave amplifier tubes. Microwave vacuum tube devices, such as power amplifiers, are essential components of many modern microwave systems including telecommunications, radar, electronic warfare and navigation systems. While semiconductor microwave amplifiers are available, they generally lack the power capabilities required by most microwave systems. Microwave vacuum tube amplifiers, in contrast, can provide higher microwave power by orders of magnitude. The higher power levels of vacuum tube devices are the result of the fact that electron can travel orders of magnitude faster in a vacuum with much less energy losses than they can travel in a solid semiconductor material. The higher speed of electrons permits the use of the larger structure with the same transit time. A larger structure, in turn, permits a greater power output, often required for efficient operations.

Microwave tube devices typically operate by introducing a beam of electrons into a region where it will interact with an input signal and deriving an output signal from the thus-modulated beam. See A. W. Scott, Understanding Microwaves, Ch 12, page 282, John Wiley and Sons, Inc., 1993, and A. S. Gilmour, Jr., Microwave Tubes, Artech House, Norwood, Mass., 1986. Microwave tube devices include gridded tubes, klystrons, traveling wave tubes or crossed-field amplifiers and gyrotrons. All of these require a source of emitted electrons.

Traditional thermionic emission cathode, e.g., tungsten cathodes, may be coated with barium or barium oxide, or mixed with thorium oxide, are heated to a temperature around 1000° C. to produce a sufficient thermionic electron emission current on the order of amperes per square centimeter. The necessity of heating thermionic cathodes to such high temperatures causes a number of problems: it limits their lifetime, introduces warm-up delays and requires bulky auxilliary equipment. Limited lifetime is a consequence of the high operating temperature that causes key constituents of the cathode, such as barium or barium oxide, to evaporate from the hot surface. When the barium is depleted, the cathode (and hence the tube) can no longer function. Many thermionic vacuum tubes, for example, have operating lives of less than a year. The second disadvantage is the delay in emission from the thermionic cathodes due to the time required for temperature ramp-up. Delays up to 4 minutes have been experienced, even after the cathode reaches its desired temperature. This length of delays is unacceptable in fast-warm-up applications such as some military sensing and commanding devices. The third disadvantage is that the high temperature operation requires a peripheral cooling system such as a fan, increasing the overall size of the device or the system in which it is deployed. The fourth disadvantage is that the high temperature environment near the grid electrode is such that the thermally induced geometrical/dimensional instability (e.g., due to the thermal expansion mismatch or structural sagging and resultant cathode-grid gap change) does not allow a convenient and direct modulation of signals by the grid voltage alterations. These problems can be resolved or minimized if a reliable cold cathode can be incorporated. Accordingly, there is a need for an improved cold-cathode based electron source for microwave tube devices which does not require high temperature heating. Such cold cathode type microwave amplifier device was disclosed by Goren, et al. in U.S. Pat. No. 6,297,592, "Microwave vacuum tube device employing grid-modulated cold cathode source having nanotube emitters", issued on Oct. 2, 2001. Sources using these carbon nanotubes provide electrons for microwave vacuum tubes at low voltage, low operating temperature and with fast-turn-on characteristics.

Figure 11:
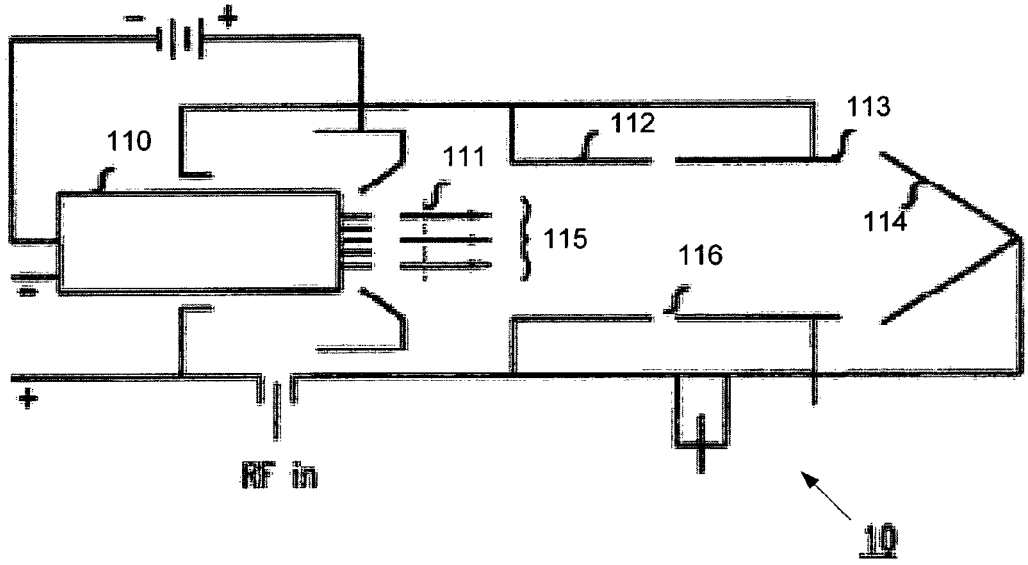
FIG. 11 is a schematic illustration of an exemplary microwave amplifier comprising the inventive aligned carbide or nitride emitter array.

Referring to the drawings, FIG. 11 is a schematic cross-sectional illustration of an exemplary inventive microwave vacuum tube comprising spaced-apait nanowire or nanocone array cold cathode with carbide or nitride emitting surface. The device of FIG. 11 is basically of "klystrode" type. The klystrode structure is of gridded tube type (other types of gridded tubes include triodes and tetrodes). The inventive device contains 5 main elements—a cathode 110, a grid 111, an anode 112, a tail pipe 113, and a collector 114. The whole tube is optionally placed in a uniform magnetic field for beam control. In operation, a RF voltage is applied between the cathode 110 and grid 111 by one of several possible circuit arrangements. For example, it is possible for the cathode to be capacitively coupled to the grid or inductively coupled with a coupling loop into an RF cavity containing the grid structure. The grid 111 regulates the potential profile in the region adjacent the cathode, and is thereby able to control the emission from the cathode. The resulting density-modulated (bunched) electron beam 115 is accelerated toward the apertured anode 112 at a high potential. The beam 115 passes by a gap 116, called the output gap, in the resonant RF cavity and induces an oscillating voltage and current in the cavity. RF power is coupled from the cavity by an appropriate technique, such as inserting a coupling loop into the RF field within the cavity. Finally, most of the beam passes through the tail pipe 112 into the collector 114. By depressing the potential of the collector 20, some of the dc beam power can be recovered to enhance the efficiency of the device.

The inventive, improved microwave amplifier structure is a very efficient device because it combines the advantages of the resonant circuit technologies of the high frequency, velocity-modulated microwave tubes (such as klystrons, traveling wave tubes and crossed-field tubes) and those of the grid-modulation technologies of triodes and tetrodes, together with the unique, cold cathode operation using high-current emission capabilities of nanowire field emitters. The inventive cold cathode allows the grid to be positioned very close to the cathode, for direct modulation of the electron beam signals with substantially reduced transit time.

Figure 12:
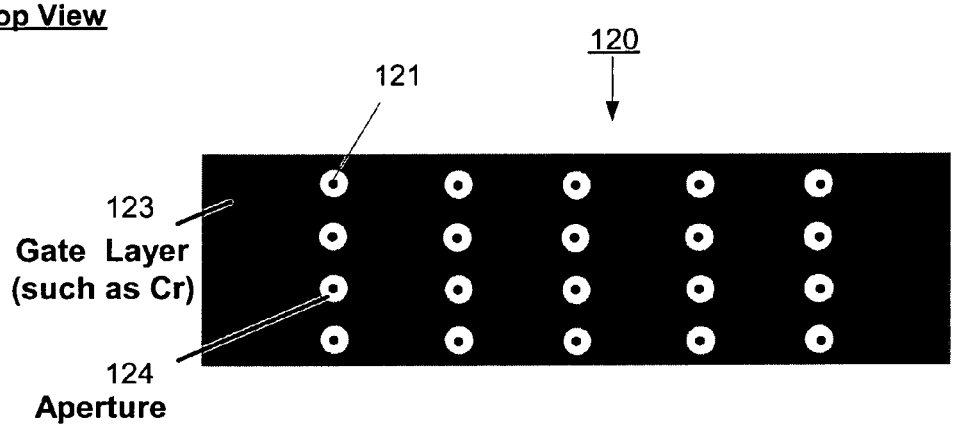
FIGS. 12(*a*) and 12(*b*) schematically illustrate an inventive field emitter comprising a layer of apertured gate layer and individual aligned carbide or nitride emitter within each cell under each gate aperture.
Figure 12:
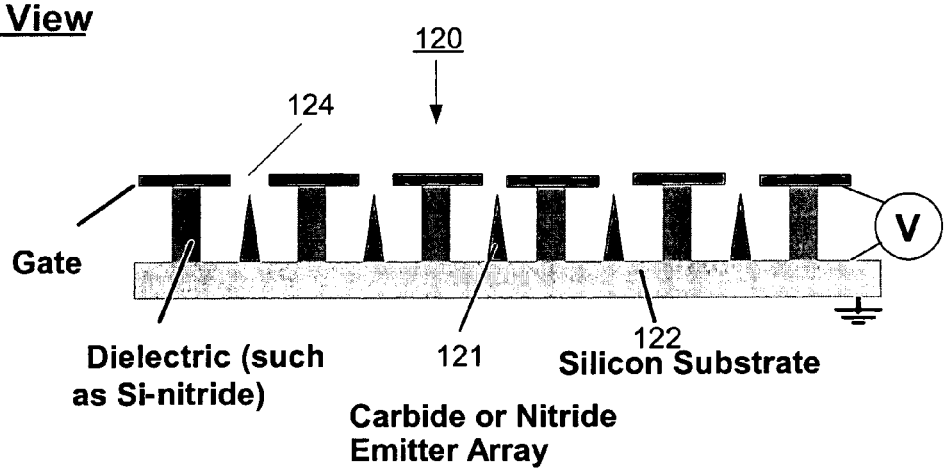

Since efficient electron emission is typically achieved by the presence of a gate electrode in close proximity to the cathode (placed about 1-100 μm distance away), it is desirable to have a fine-scale, micron-sized gate structure with as many gate apertures as possible for maximum emission efficiency and minimize the heating effect caused by electrons intercepted by the gate grids. The grid in the inventive, cold cathode type, vacuum tube device is made of conductive metals, and has a perforated, mesh-screen or apertured structure so as to draw the emitted electrons yet let the electrons pass through through the apertures and move on to the anode. Such an apertured gate structure is schematically illustrated in FIGS. 12(*a*) and 12(*b*). The apertured grid structure 120 can be prepared by photolithographic or other known patterning technique, as is commercially available. An array of carbide or nitride emitters 121 is formed on an insulated substrate 122 beneath a supported apertured gate layer 123. The desired average size of an aperture 124 is in the range of 0.5-500 μm, preferably 1-100 μm, even more preferably 1-μm. The grid structure 120 in the present invention can also be in the form of a fine wire mesh screen, typically with a wire diameter of 5-50 μm and wire-to-wire spacing (or aperture size) of 10-500 μm. The shapes of apertures 124 can be either circular, square or irregular.

Within each aperture area, a multiplicity of optimally spaced-apart carbide or nitride nanoscale emitters attached on the cathode surface emit electrons when a field is applied between the cathode and the grid. A more positive voltage is applied to the anode in order to accelerate and impart a relatively high energy to the emitted electrons. The grid is a conductive element placed between the electron emitting cathode and the anode. It is separated from the cathode but is kept sufficiently close in order to induce the emission.

The grid can be separated from the cathode either in a suspended configuration or with an electrically insulating spacer layer such as aluminum oxide. The dimensional stability of the grid, especially the gap distance between the cathode and the grid, is important, for example, in the case of unavoidable temperature rise caused by electron bombardment on the grid and resultant change in dimension and sometimes geometrical distortion. It is desirable that the grid be made with a mechanically strong, high melting point, low thermal expansion metal such as a refractory or transition metal such as Cr or W.

Field Emission Displays

Figure 13:
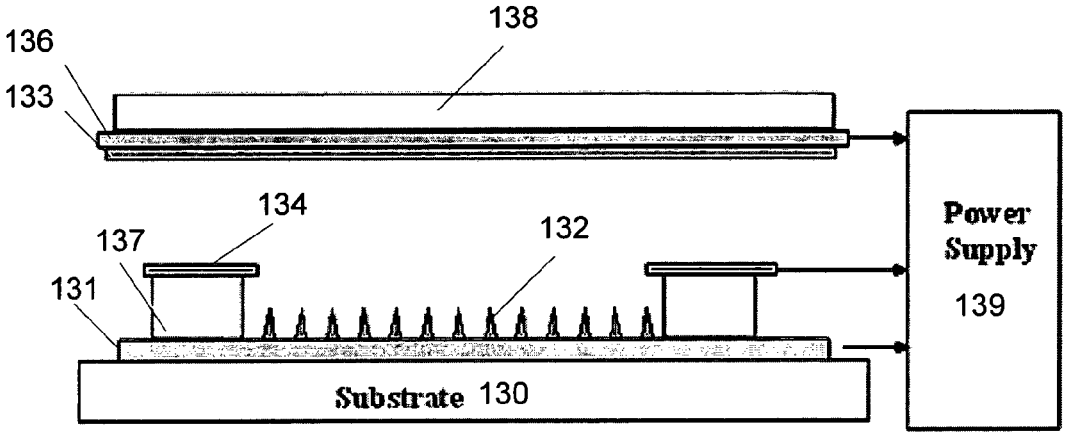
FIG. 13 is a schematic illustration of an exemplary field emission display comprising the inventive aligned carbide or nitride emitter array.

The spaced-apart and aligned carbide or nitride nanowire/nanocone array emitters as described in this invention can also be utilized to make unique, flat-panel, field emission displays, such as schematically illustrated in FIG. 13. Here, the "flat-panel displays" is defined as meaning "thin displays" with a thickness of e.g., less than ~10 cm. Field emission displays can be constructed with either a diode design (i.e., cathode-anode configuration) or a triode design (i.e., cathode-grid-anode configuration). The use of grid electrode is preferred as the field emission becomes more efficient. Advantageously this electrode is a high density aperture gate structure place in proximity to the spaced-apart nanowire emitter cathode to excite emission. Such a high density gate aperture structure can be obtained e.g., by lithographic patterning.

For display applications, emitter material (the cold cathode) in each pixel of the display desirably consists of multiple emitters for the purpose, among others, of averaging out the emission characteristics and ensuring uniformity in display quality. Because of the nanoscale array nature of the inventive field emitters, the carbide or nitride emitter provides many emitting points, but because of field concentration desired, the density of nanotubes in the inventive device is restricted to less than $100/(\mu m)^2$. Since efficient electron emission at low applied voltage is typically achieved by the presence of accelerating gate electrode in close proximity (typically about 1 μm distance), it is useful to have multiple gate aperture over a given emitter area to maximally utilize the capability of multiple emitters. It is also desirable to have fine-scale, micron-sized structure with as many gate apertures as possible for maximum emission efficiency.

The field emission display in this invention, FIG. 13, comprises a substrate 130 on which a conductive layer 131 serves as a cathode layer, a plurality of spaced-apart and aligned nanotube emitters 132 attached on the conductive substrate, and an anode 136 disposed in spaced relation from the emitters within a vacuum seal. The transparent anode conductor formed on a transparent insulating substrate 138 (such as a glass) is provided with a phosphor layer 133 and mounted on support pillars (not shown). Between the cathode and the anode and closely spaced from the emitters is a perforated conductive gate layer 134. Conveniently, the gate 134 is spaced from the cathode 131 by a thin insulating layer 137.

The space between the anode and the emitter is sealed and evacuated, and voltage is applied by power supply 139. The field-emitted electrons from nanotube emitters 132 are accelerated by the gate electrode 134, and move toward the anode conductive layer 136 (typically transparent conductor such as indium-tin-oxide) coated on the anode substrate 138. Phosphor layer 133 is disposed between the electron emitters and the anode. As the accelerated electrons hit the phosphor, a display image is generated.

Electron Source Array for Nano Fabrication

Figure 14:
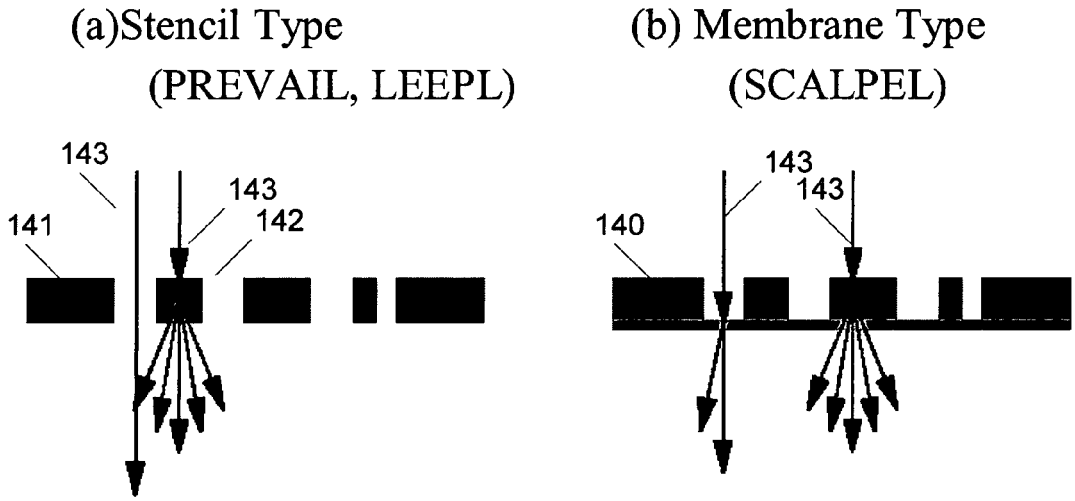
FIG. 14 schematically illustrates the two main types of masks for generating contrasts in e-beam projection lithography techniques (stencil type vs membrane type)

Nano fabrication technologies are crucial for construction of new nano devices and systems as well as for manufacturing of next generation, higher-density semiconductor devies. Conventional e-beam lithography with its single-line writing characteristics is inherently slow and costly. Electron-beam projection lithography (EPL) technology, which is sometimes called as SCALPEL (SCattering with Angular Limitation Projection Electron-beam Lithography), PREVAIL (Projection Reduction Exposure with Variable Axis Immersion Lenses) or LEEPL (Low-Energy E-beam Proximity Lithography) depending on specific designs, offers a possibility of nanoscale lithography for fabrication of nano devices and nano circuits. These techniques can use either a membrane-type mask 140 or stencil-type mask 141 depending on the EPL design as illustrated schematically in FIG. 14. In the stencil type masks, physically empty patterns 142 (holes, lines, etc.) are provided on the mask substrate through which the e-beam 143 passes and reaches the object to be e-beam patterned. In the membrane type masks, the differential scattering of electrons is utilized to generate the contrast for lithography patterning.

Figure 15:
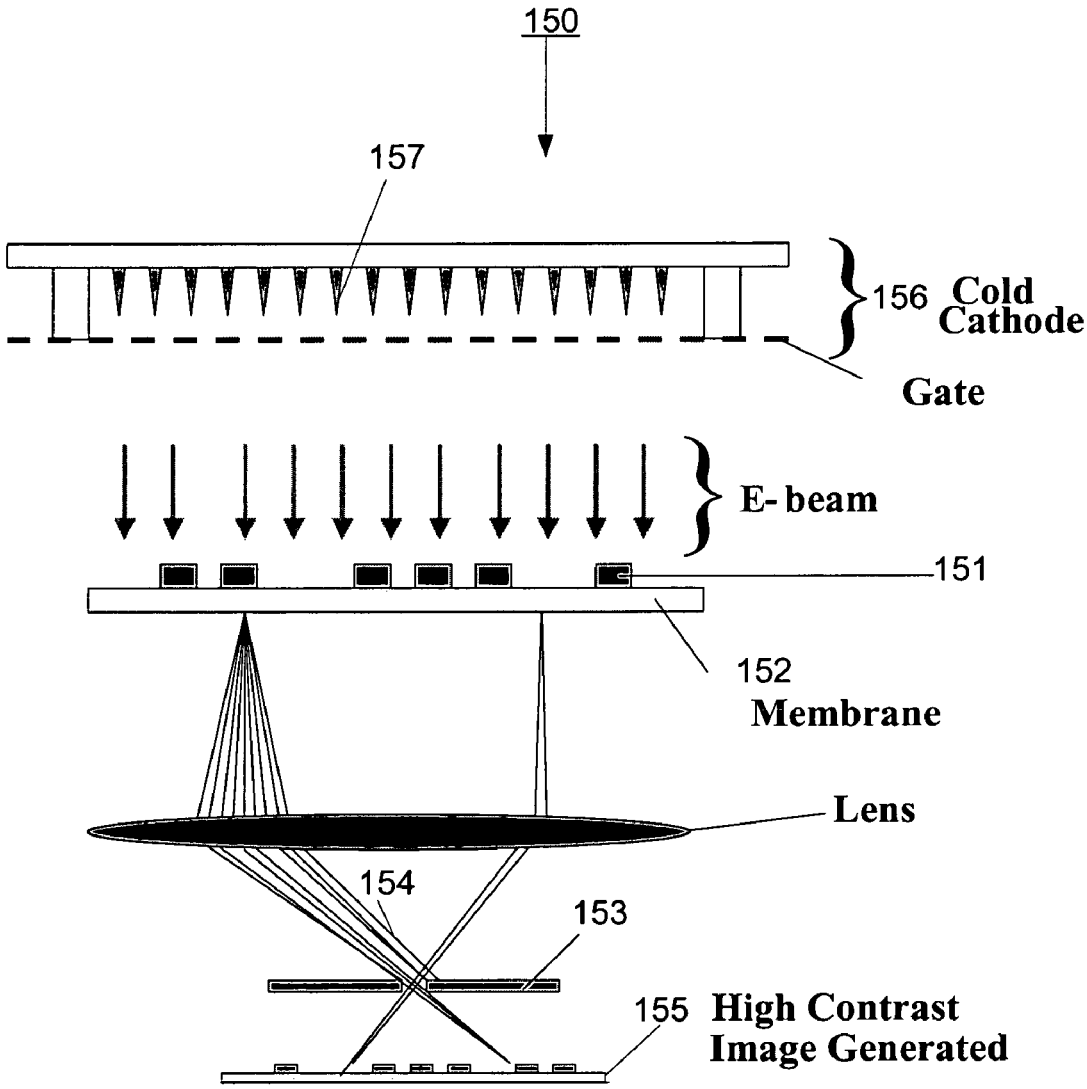
FIG. 15 schematically illustrates an exemplary e-beam projection lithography apparatus comprising a cold cathode with the inventive aligned carbide or nitride emitter array.

As an example of EPL technologies, the SCALPEL type e-beam projection lithography technique is disclosed in U.S. Pat. Nos. 5,701,014 and 5,079,112 by Berger, et al., and No. 5,532,496 by Gaston. The projection e-beam lithography may be able to handle ~1 $cm^2$ type exposure at a time with the exposure time of <1 second. In the exemplary electron-beam projection lithography tool 150 illustrated in FIG. 15 (SCALPEL type), the mask 151 consists of a low atomic number membrane 152 covered with a layer of a high atomic number material, and contrast is generated by utilizing the difference in electron scattering characteristics between the membrane material and the patterned mask material. The membrane scatters electrons weakly and to small angles, while the patterned mask layer scatters them strongly and to high angles. An aperture 153 in the back-focal plane of the projection optics blocks the strongly scattered electrons 154, forming a high contrast image 155 at the wafer plane to be e-beam patterned as illustrated in FIG. 15. In an exemplary operation of the tool, the mask is uniformly illuminated by a parallel beam of, e.g., 100 keV electrons generated by the inventive cold cathode 156 comprising the carbide or nitride field emitters 157. A reduction-projection optic, produces a 4:1 demagnified image of the mask at the wafer plane. Magnetic lenses can be used to focus the electrons.

The inventive stable carbide or nitride field emitter array can be used for EPL systems with either the stencil-type masks or the membrane type masks.

Plasma Displays

Figure 16:
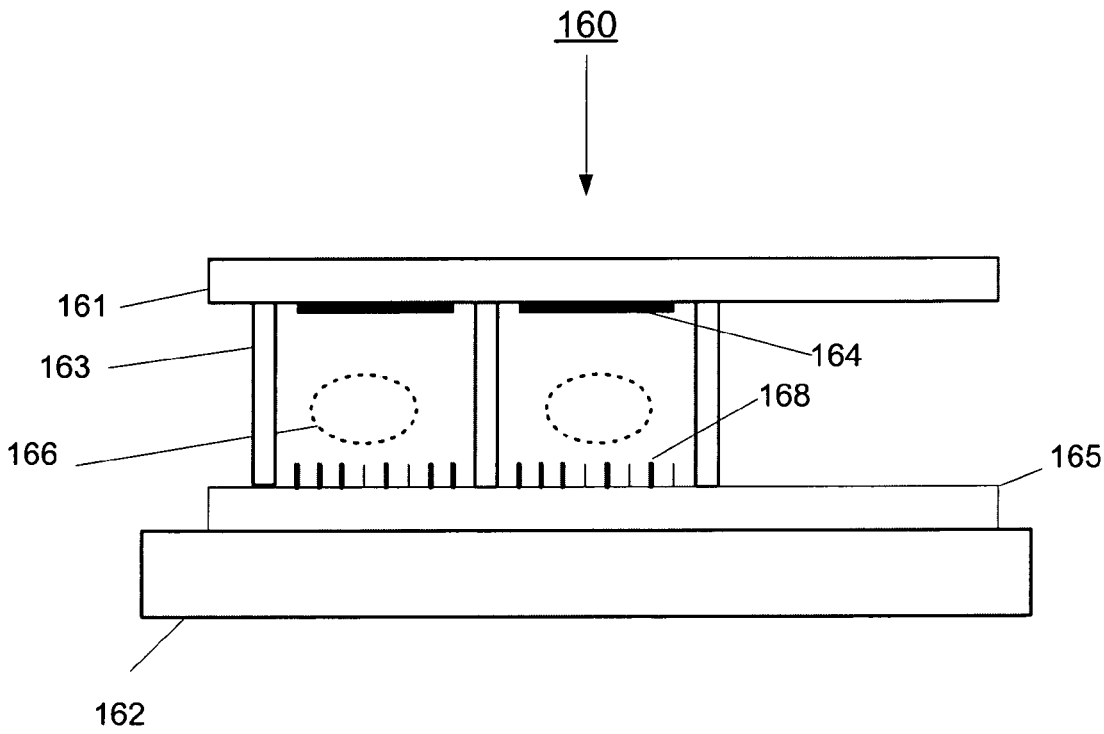
FIG. 16 schematically illustrates an inventive plasma display device comprising aligned carbide or nitride nanoneedle or nanocone structure for low voltage operation of the display.

FIG. 16 schematically illustrates an inventive plasma display device comprising aligned carbide or nitride nanoneedle or nanocone structure for low voltage operation of the display.

The spaced-apart and aligned carbide or nitride nano emitter structure according to the invention is also useful in improving the performance and reliability of flat panel plasma displays. Plasma displays utilize emissions from regions of low pressure gas plasma to provide electrodes within a visible display elements. A typical display cell comprises a pair of sealed cell containing a noble gas. When a sufficient voltage is applied between the electrodes, the gas ionizes, forms a plasma, and emits visible and ultraviolet light. Visible emissions from the plasma can be seen directly. Ultraviolet emissions can be used to excite visible light from phosphors. An addressable array of such display cells forms a plasma display panel. Typically display cells are fabricated in an array defined by two mating sets of orthogonal electrodes deposited on two respective glass substrates. The region between the substrates is filled with a noble gas, such as neon, and sealed.

Plasma displays have found widespread applications ranging in size from small numeric indicators to large graphics dismays. Plasma displays are strong contenders for future flat panel displays for home entertainment, workstation displays and HDTV displays. The advantage of using a low work function material to lower the operating voltage is described in U.S. Pat. No. 5,982,095 by Jin et al., "Plasma displays having electrodes of low-electron affinity materials", issued on Nov. 9, 1999. The nano emitter array according to the invention can provide improved plasma displays as the efficient electron emission from the spaced-apart and aligned nanowires or nanocones allow the operation of plasma displays at reduced operating voltages, higher resolution, and enhanced robustness.

FIG. 16 schematically illustrates an improved display cell in accordance with the invention. The cell 160 comprises a pair of glass plates 161 and 162 separated by barrier ribs 163. One plate 161 includes a transparent anode 164. The other plate 10 includes a cathode 165. The plates 161, 162 are typically soda lime glass. The anode 164 is typically a metal mesh or an indium-tin-oxide (ITO) coating. The cathode 165 is either metal such as Ni, W and stainless steel or a conductive oxide. A noble gas 167 such as neon, argon or xenon (or mixtures thereof) is filled in the space between the electrode. The barrier ribs 163 are dielectric, and typically they separate plates 161, 162 by about 200 micrometers. In operation, a voltage from a power supply (not shown) is applied across the electrodes. When the applied voltage is sufficiently high, a plasma 166 forms and emits visible and ultraviolet light. The presence of the inventive nanowire structure 168 will allow the plasma 166 to be generated at lower voltages because electron emission from the nanowire under electrical field or upon collision with ions, metastables and photons is much easier than with conventional materials. This facilitated emission greatly reduces the power consumption, simplifies the driver circuitry, and permits higher resolution.

It can now be seen that one aspect of the invention includes a method of making an array of nanoscale carbide or nitride field emitters comprising the steps of providing a substrate supporting an array of projecting carbon nanostructures and forming a carbide or nitride coating overlying the nanostructures. Carbide field emitters are advantageously formed by depositing metal overlying the carbon nanostructures under conditions to form the metal carbide nanostructures. Nitride field emitters are advantageously formed by depositing metal overlying the carbon nanostructures in a nitrogenous ambient. An optional heating step to facilitate carbide or nitride formation can be in the range 500-2500° C. for 1 min. to 1000 hrs. and preferably in the range 800-1600° C. for 5 min. to 100 hrs.

Preferably the carbide or nitride coating comprises refractory carbide or nitride. Useful carbide field emitters include HfC, TaC, WC, ZrC, NbC, TiC, VC and $Cr_3C_2$. Useful nitride field emitters include HfN, TaN, WN, ZrN, NbN, MoN, TiN, VN and CrN. Advantageously the coating is formed overlying at least 20% of the surface of the upper one-third of the projecting carbon nanostructure. The thickness of the coating can be in the range 0.5-100 nm and preferably 2-20 nm.

Material disposition on the carbon nanostructure (metal, carbide or nitride material) can be deposited by sputtering, evaporation (thermal or electron beam), laser ablation or chemical vapor disposition (CVD). The coating can comprise depositing at oblique incidence to the substrate and rotating the substrate to reduce shadowing effects.

The projecting carbon nanostructures can be nanotubes, nanowires or nanocones. Advantageously for field emission, the nanostructures have tip regions with radii of curvature less than 200 nm and preferably less than 50 nm. Preferred carbon nanotubes have diameters less than 200 nm and preferably less than 50 nm. Advantageously nanocones have base diameters in the range 20-2000 nm and an aspect ratio in the range 20-2000 nm and an aspect ratio in the range 1-50. Preferably they have bases in the range 50-500 nm and an aspect ratio of 2-10. Nanocones can have tips with radii of curvature of 5 nm or less.

In another aspect of the invention a coating layer of resistive material can be formed overlaying the projecting carbon nanostructure before forming the carbide or nitride coating overlaying both the resistive coating and the carbon nanostructure. The resistive coating effectively provides a resistance in series with the emitting tip to limit the current to strong emitter tips and provide more uniform emission. The resistive coatings can be semiconductors such as Si or ZnO.

In the alternative, the substrate-supported projecting nanostructures can comprise semiconductor material such as Si, ZnO, GaN and GaAs.

In yet another aspect, the invention includes articles comprising substrate-supported array of metal carbide or metal nitride nanoscale field emitter overlaying carbon or semiconductor projecting nanostructures. The emitters are advantageously disposed in a two-dimensional spaced array, preferably with substantially uniform spacing and height. It includes, among others, a microwave amplifier comprising such an emitter array, a field emission display comprising the array, an electron source array and plasma display comprising the array.

It is understood that the above-described embodiments are illustrative of only a few of the many possible specific embodiments which can represent applications of the invention. Numerous and varied other arrangements can be made by those skilled in the art without departing from the spirit and scope of the invention.

What is claimed is:

1. A method of making an array of nanoscale carbide or nitride field emitters comprising:

providing a substrate supporting an array of projecting carbon nanostructures;

forming a carbide or nitride coating overlying the carbon nanostructures; and forming a layer of resistive material overlying the projecting carbon nanostructure and underlying the carbide or nitride coating, wherein forming the carbide coating includes depositing metal overlying the carbon nanostructures, and forming the nitride coating includes depositing metal overlying the carbon nanostructures and heating the metal on the carbon nanostructures in an ambient including nitrogen or a nitrogen compound to form metal nitride coating on the carbon nanostructures.

2. The method of claim 1 wherein the carbide or nitride is a refractory carbide or nitride.

3. The method of claim 1 wherein the field emitters are carbide field emitters selected from the group consisting of HfC, TaC, WC, ZrC, NbC, TiC, VC and $Cr_3C_2$.

4. The method of claim 1 wherein field emitters are nitride emitters selected from the group consisting of HfN, TaN, WN, ZrN, NbN, MoN, TiN, VN and CrN.

5. The method of claim 1 wherein the carbide or nitride coating is formed overlying at least 20% of the surface of the upper one-third of the projecting carbon nanostructure.

6. The method of claim 1 wherein the thickness of the carbide or nitride coating is in the range of 0.5-100 nm.

7. The method of claim 6 wherein the thickness of the carbide or nitride coating is in the range of 2-20 nm.

8. The method of claim 1 wherein the carbide or nitride coating is formed by a step comprising puttering, thermal evaporation, electron beam evaporation, laser ablation or chemical vapor disposition.

9. The method of claim 1 wherein the carbide or nitride coating is formed by a step comprising deposition at oblique incidence while rotating the substrate to reduce shadowing effects.

10. The method of claim 1 wherein the projecting carbon nanostructures are carbon nanotubes having diameters less than 200 nm.

11. The method of claim 10 wherein the projecting carbon nanostructures are carbon nanotubes having diameters less than 50 nm n.

12. The method of claim 1 wherein the projecting carbon nanostructure have tip regions with radii of curvature less than 200 nm.

13. The method of claim 12 wherein the projecting carbon nanostructure have tip regions with radii of curvature less than 50 nm.

14. The method of claim 1 wherein the metal is heated on the carbon nanostructure to form a metal carbide coating in an inert gas or carbon-containing gas.

15. The method of claim 1 wherein the heating of the metal on the carbon nanostructure to form the metal carbide coating is at a temperature in the range of 500-2500° C. for 5 min. to 1000 hrs.

16. The method of claim 1 wherein the heating is at a temperature in the range of 800-1600° C. for 5 min. to 100 hrs.

17. The method of claim 1 wherein the projecting carbon nanostructures are carbon nanotubes, carbon nanowires or carbon nanocones.

18. The method of claim 1 wherein the projecting carbon nanostructures are carbon nanocones having a base diameter in the range of 20-2000 nm and an aspect ratio in the range of 1-50.

19. The method of claim 1 wherein the projecting carbon nanostructures are carbon nanocones having a base diameter in the range 50-500 nm and an aspect ratio in the range of 2-10.

20. The method of claim 1 wherein the projecting carbon nanostructures have a tip with a radius of curvature of about 5 nm.

* * * * *